US011325738B1

(12) United States Patent
Thomas

(10) Patent No.: US 11,325,738 B1
(45) Date of Patent: May 10, 2022

(54) DRINK STACKER STORAGE SYSTEMS

(71) Applicant: Ray Thomas, Miami, FL (US)

(72) Inventor: Ray Thomas, Miami, FL (US)

( * ) Notice: Subject to any disclaimer, the term of this patent is extended or adjusted under 35 U.S.C. 154(b) by 0 days.

(21) Appl. No.: 17/120,132

(22) Filed: Dec. 12, 2020

(51) Int. Cl.
*B65D 1/24* (2006.01)
*A47B 87/02* (2006.01)

(52) U.S. Cl.
CPC ..... *B65D 1/243* (2013.01); *A47B 87/0269* (2013.01)

(58) Field of Classification Search
CPC ..... B65D 1/243; B65D 1/24; A47B 87/0269; A47B 73/006; A47F 7/283
See application file for complete search history.

(56) References Cited

U.S. PATENT DOCUMENTS 2,323,491 A * 7/1943 Schneeberger ..... B65D 85/305 217/19
2,574,983 A * 11/1951 Reed ..... B65D 85/305 206/139
2,630,924 A * 3/1953 Vacanti ..... A47B 87/0269 211/125
3,106,308 A 10/1963 Kazimier
3,245,573 A * 4/1966 Bakos ..... B65D 1/243 220/516
3,331,502 A * 7/1967 Stroop ..... B65D 1/243 206/432
3,341,053 A * 9/1967 Keene ..... B65D 1/243 206/427
3,664,274 A * 5/1972 Bustos ..... A47B 57/265 108/151
3,704,792 A 12/1972 Wiese
RE28,293 E * 1/1975 Bustos ..... A47B 87/0269 108/151
4,040,517 A * 8/1977 Torokvei ..... B65D 1/243 220/519
4,136,429 A * 1/1979 Brandes ..... B01L 9/06 40/324
4,342,388 A * 8/1982 Torokvei ..... B65D 71/0003 206/203
4,599,314 A * 7/1986 Shami ..... C12M 23/12 294/160
4,655,360 A * 4/1987 Juhanson ..... B65D 1/243 220/519
4,911,303 A * 3/1990 Andersson ..... B65D 1/243 206/509

(Continued)

FOREIGN PATENT DOCUMENTS

CA 1085789 A * 9/1980 ..... B65D 1/243
DE 4425569 A1 * 1/1996 ..... B65D 1/243

*Primary Examiner* — Stanton L Krycinski

(57) ABSTRACT

According to an aspect of the present invention, a stackable storage rack system suitable for storing containers is provided. The system includes a base. The system also includes a plurality of compartments positionable within the base, wherein the compartments form a cavity within the base and have an opening on a top of the base designed to store containers. The system further includes at least 4 legs, wherein a top of the legs are connected to a bottom of the base at four separate bottom corners of the base. Additionally, the system includes an operational space formed by stacking at least two storage racks one on top of another wherein users of the system can retrieve containers from the bottom storage rack without interference from the top storage rack.

9 Claims, 9 Drawing Sheets

(56) References Cited

U.S. PATENT DOCUMENTS 4,940,150 A * 7/1990 Spengler ..... A47B 87/0223 211/188
5,158,187 A * 10/1992 Taub ..... A47B 87/0223 211/186
D333,093 S * 2/1993 Rehrig ..... D9/456
5,722,544 A * 3/1998 Williams ..... A47B 87/008 211/186
5,918,751 A * 7/1999 Kelly ..... A47F 7/28 211/126.2
6,640,981 B2 * 11/2003 Lafond ..... B01L 9/06 422/561
6,840,390 B2 * 1/2005 Thomas ..... B65D 1/243 206/804
6,971,518 B1 * 12/2005 Lowry ..... B65D 71/70 211/74
7,191,904 B2 * 3/2007 Wescott, III ..... B01L 9/06 211/74
7,258,240 B2 * 8/2007 Wescott, III ..... B01L 9/06 211/74
8,757,400 B2 * 6/2014 Bosch ..... B01L 9/06 211/74
9,572,306 B2 * 2/2017 Chiang ..... A47G 7/041
9,618,252 B2 * 4/2017 Andrews ..... F25D 3/08
9,914,200 B2 * 3/2018 Wetherill ..... C03C 21/002
2002/0108917 A1 * 8/2002 Maruyama ..... B01L 9/50 211/74
2005/0039391 A1 * 2/2005 Morse ..... A01K 63/006 47/39
2008/0053940 A1 * 3/2008 Whalen ..... A47F 5/0043 211/134
2009/0119987 A1 * 5/2009 Ingrassia ..... A01G 9/028 47/66.5
2019/0008275 A1 * 1/2019 Sosna ..... A47B 87/0253
2019/0059583 A1 * 2/2019 Sullivan ..... A47F 5/10
2019/0382151 A1 * 12/2019 Thomas ..... B65D 71/70

* cited by examiner

DRINK STACKER STORAGE SYSTEMS

FIELD OF THE INVENTION

The present invention relates generally to drink storage systems, and more particularly, to drink stacker storage systems, which utilize multiple modular stackable and interconnectable drink storage units to efficiently store beverages for easy access.

BACKGROUND OF THE INVENTION

Many methods and devices have been unsuccessfully attempted to efficiently and effectively, provide simple and easy to use systems to store beverages in any location. Several devices, systems, and methods have been created and implemented to address the problem of having a variety of different beverages stored simultaneously in a variety of locations while being able to easily access and retrieve the beverages individually. The additional space required to separate different beverages, stack, access, and retrieve them adds additional costs to any business operation and creates the need for additional space in both commercial and residential uses.

Quite often large packages of beverages are purchased for personal consumption and when the packages are stored at their homes, the nested packaging of bulky products consumes and occupies a large space on the floor or other horizontal surfaces and provides limited options for placement. Further, when these large packages are kept in their original packaging, accessing an individual beverage, whether the beverages are in a refrigerated area or stored at room temperature, not only is it unappealing, it makes grabbing an individual beverage awkward and inefficient.

Further, previous methods utilized to minimize storage space requirements have been expensive and cumbersome to utilize. Quite often, the need for additional storage space and equipment are needed to efficiently store a plurality of beverages in different storage areas which render the process more time consuming and expensive. The drink stacker system offers a variety of storing combinations and an improved method and alternative for the storage of beverages after purchase.

These additional pieces of equipment and storage spaces result in additional expenses and make ease of access and the retrieval of beverages to individuals cumbersome.

Accordingly, there is an established need for drink stacker systems which solve at least one of the aforementioned problems. Further, there is an established need for drink stacker storage systems which can be utilized more efficiently and effectively and provide stowage devices to access individual beverages while minimizing storage space.

SUMMARY OF THE INVENTION

The present invention is directed to innovative and cost-effective devices, systems, and methods of manufacturing and providing drink stacker storage systems. Further, the present invention is directed to innovative, ergonomically designed, drink stacker storage systems which reduces awkward storage of large packaged beverages and allows accessing beverages to individuals easier, more efficient, and more aesthetically pleasing to the surrounding space wherein the beverages are stored.

According to an aspect of the present invention, a stackable storage rack system suitable for storing containers is provided. The storage rack system includes a base. The storage rack system also includes a plurality of compartments positionable within the base, wherein the compartments form a cavity within the base and have an opening on a top of the base designed to store containers. The storage rack system further includes at least 4 legs, wherein a top of the legs are connected to a bottom of the base at four separate bottom corners of the base. Additionally, the storage rack system includes an operational space formed by stacking at least two storage racks one on top of another wherein the operational space is formed between a bottom of the legs and the top of the legs of a top storage rack placed on top of a bottom storage rack wherein users of the system can retrieve containers from the bottom storage rack without interference from the top storage rack and wherein the operational space is determined by a length of the legs of the top storage rack.

In embodiments, the system can include legs, wherein the bottom of the legs are configured to mate with and rest on a top of the base of a storage rack below it.

In embodiments, the system can include a base with at least two elongated supporting rails positioned parallel and inside a bottom of s storage rack configured to secure the containers placed in the compartments.

In embodiments, the system can include storage rack with corrugated depressions on a border of the storage rack designed to provide stability when the storage racks are stacked on top of another.

In embodiments, the system can include compartments with a depth wherein the depth is configured to be around 70% of a height of containers designated to be stored in the compartments.

In embodiments, the system can include a storage rack with a height of about 8.35 inches, compartments with a depth of about 4.84 inches, and a width of the storage rack is about 7.75 inches.

In embodiments, the system can include an insulating layer.

In embodiments, the system can include compartments with a drain hole at a bottom of the compartment.

In embodiments, the system can include acrylonitrile butadiene styrene (ABS) plastic.

In an embodiment of the present invention, the drink stacker storage system can include materials such as Polylactic acid (PIA).

In another embodiment, the system can also include Thermoplastic polyurethane (TPU).

In embodiments, the system can include stackable racks. The racks structured to allow easy access to any beverage on any rack in a plurality of arrangements including vertical and horizontal storage arrangements.

In embodiments, the system can include interconnecting racks, the racks configured to be stacked vertically and/or horizontally without the need of any tools to interconnect.

In embodiments, the system can include rack legs, the rack legs configured to provide a space opening between rack compartments such that individual racks can be manipulated manually. Further, the space openings can be constructed to allow access to containers stored in the compartments and to remove and/or insert containers from their respective compartments without interference from surrounding containers and/or system components and/or other racks stacked vertically and/or horizontally.

In embodiments, the system can include openings with a depth dimension less than the total depth dimension for cylindrical compartments. Additionally, the system can include racks which can be joined by one or a plurality of elongated mating sides enclosed inside the rack which can extend from end to end and can provide support to containers when they are inserted into rack compartments.

In an aspect, the system can include materials such as, but not limited to wood, ceramic, metal, composites, and/or synthetic materials designed such that the system can be easily, maneuvered and transported.

In another aspect, the system can also include an anti-microbial coating.

In an embodiment, a method for manufacturing the system can include laser processes for cutting material to manufacture components of the system.

In an embodiment, the system can include rectangular, hexagonal, oval, trapezoidal, circular, and/or other multi-sided shapes. In embodiments, the shape of the system can be configured to interface with a vehicle such as, but not limited to a boat, car, truck, or any moving vehicle while maintaining the beverages stable in their storage location.

In embodiments, the system can include stackable bottle racks configured to accommodate 12 compartments for stowage of containers. The system can be designed to safely, hold a plurality of containers which can include, but are not limited to bottled water, canned goods, open beverage containers, and/or hot and cold beverages.

In embodiments, the system can include insulated compartments for maintaining containers at desired temperatures.

In embodiments, the system can accommodate containers of various sizes and shapes including but not limited to 3, 6, 12, 16, 40, 64, 128 and/or 7,040 ounces and/or any volume in between.

In another embodiment, the system can also include materials, such as but not limited to aluminum, steel, composites, synthetic plastics, and/or rubberized material. The material structured to provide resistance to infectious diseases, water resistance and/or anti-microbial properties.

In yet another embodiment, the system can include manufacturing methods such as but not limited to 3-D printing, injection molding, laser cutting, CNC processes, extrusion, dye cutting and/or stamping, hand cutting, and/or sawing. The methods configured to minimize production time and/or cost.

In an aspect, the system can include coating materials. The coating materials arranged to mitigate microbial and/or viral transmission. Further, the coatings can be configured to retard moisture and/or eliminate unwanted biological growth.

In another embodiment, the system can also include polypropylene configured to produce the system with injection molding.

In an aspect, the system can include insulating layers, the insulating layers configured to maintain temperature of beverages within a desired range and to maintain cold beverages cold and hot beverages hot.

In another aspect, the system can be configured to allow individuals to select a beverage without interference from components of the system.

In yet another aspect, the system can include single serving beverage container ports configured to be positionable on push carts for restaurant use.

In embodiments, the system can include portable drink stacker storage systems designed to be portable with one person.

In yet another aspect, the system can include multiple trays, so that they can be pre-loaded before coming on-site and have the vendor open up another tray when a current one is empty. The trays may be arranged in a horizontal fashion and stacked in a vertical manner, much like dresser drawers.

In embodiments, the system can include openings at the bottom of the compartments. The openings configured to allow condensation to drain out from the compartment. Also, the openings can be arranged to allow routine cleaning of racks and allowing cleaning water to exit the bottom of the compartments to allow proper drying.

In embodiments, the system can include a storage vessel and a stackable bottle rack for storing water.

In embodiments, the system can include a stackable storage rack configured to fit standard bottled water including 16.9 ounce bottles.

In embodiments, the system can include storage racks constructed of lightweight material such that the storage racks are easy to carry and transport by a single person.

In embodiments the system can include interchangeable top and bottom configured to fit into residential refrigerators.

In embodiments the system can include storage racks with cylindrical compartments.

In embodiments the system can include storage racks with individual storage compartments wherein containers can be stored vertically or horizontally.

In embodiments the system can include storage racks wherein the racks can include plastic rectangular, square, oval, round, or trapezoidal shapes.

In embodiments the system can include storage racks wherein the racks can include parallel-sided plastic.

In embodiments the system can include storage racks with inter-fitting vertical and horizontal corrugated depression or groves formed around the top or surrounding borders to support the storage rack.

The system can include storage racks wherein the storage racks can include a bottom interior with two elongated mating sides.

The system can include storage racks with elongated mating sides when the sides are constructed to prevent containers or bottles from falling through.

The system can include storage racks wherein the racks can include a coating on surfaces of the storage racks.

The system can include storage racks wherein the storage racks can include a plurality of coatings and wherein different coatings can be applied to different portions and surfaces of the storage racks. For example, the storage racks can include anti-microbial coatings applied to where people reach in to retrieve a bottle.

The system can include anti-friction coatings on surfaces configured to interconnect a plurality of storage racks.

The system can include storage racks with legs wherein the legs are dimensioned to a space between stacked storage racks configured to allow easy retrieval of bottles or container from storage racks which are positioned or which are below other storage racks.

The system can include a plurality of storage racks interconnected vertically and horizontally without the need for tools.

The system can include storage racks wherein the storage racks include handles. The handles can be positionable on various portions of the racks allowing ease of transporting the racks and placement of the racks.

The system can include legs which are contoured and have inside sections which are concave and smooth to allow a user to reach into a storage rack which may be positioned below another storage rack such that when a user reaches in to retrieve a beverage from a compartment in a storage rack and their hand makes incidental contact with the interior of a leg, there will be no corners or sharp edges wherein the user's hand may be harmed.

These and other objects, features, and advantages of the present invention will become more apparent from the attached drawings and the detailed description of the preferred embodiments, which follow. It is understood, that the drawings are designed for the purposes of illustration and not as a definition of the limits of the embodiments of the present invention. It should be further understood that the drawings are not necessarily drawn to scale and are merely intended to conceptually illustrate the methods and systems described herein.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

The following detailed description is exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
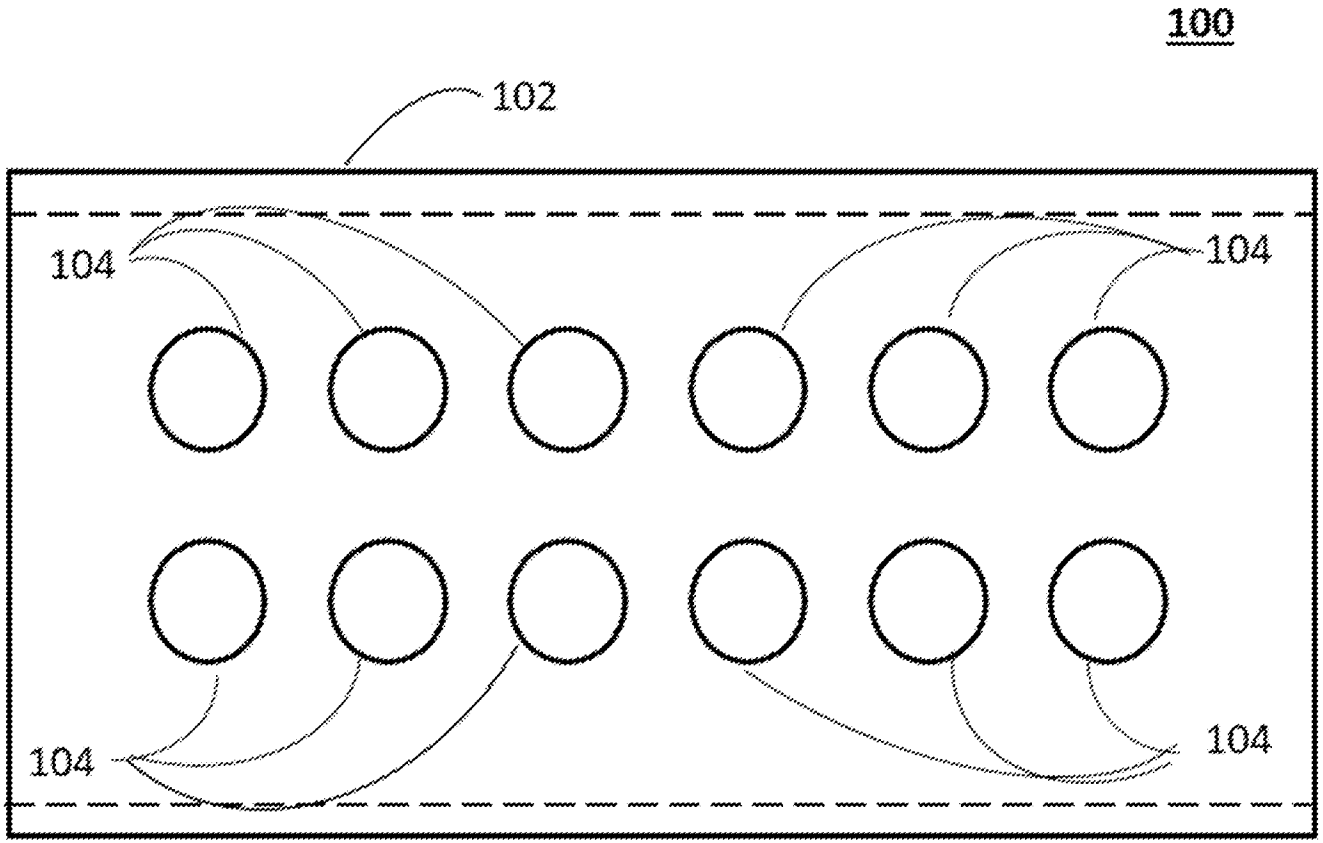
FIG. 1 presents a top view of an embodiment of a system incorporated in a storage rack, in accordance with an embodiment of the present invention.

Referring initially to FIG. 1, a top view of a drink stacker storage system 100 is displayed. As shown, an embodiment of the present invention can include a base 102 wherein compartments 104 can be positioned within. The compartments 104 can be of various depths, shapes, and dimensions and number. As shown, the compartments 104 are circular and uniformly placed on the base. The compartments 104 form voids or storage locations for containers to be placed within. As seen in FIG. 1 the embodiment shows 12 compartments 104. However, the number of compartments 104 can vary based on the use of the storage racks 108. For example, there can be 2, 4, 6, 8, 10, 12, 14, 24, 36, or 48 compartments 104 or any number in between located on the base 102. Further, the shape of the compartment 104 opening can be circular, rectangular, square, triangular, trapezoidal, or hexagonal based on the intended use of the storage rack 108 contemplating the shape of the container that will be stored on the storage rack 108. Additionally, the depth of the compartment 104 may vary based on the type of container that is intended to be stored. The depth of the compartment 104 may be 1, 2, 4, 6, 8, 10, 12, or 24 inches or any dimension in between based on the size of the container that will be stored on the storage rack 108. Moreover, the placement of the compartments 104 may be in an array form, uniformly placed, symmetrically placed, or unsymmetrically placed. In some embodiments the compartments 104 are placed on the base 102 in an arc fashion. Furthermore, the opening size can vary depending upon the size of the container that will be stored on the storage rack 108. For example, the compartment 104 opening can be 1, 2, 4, 6, 8, 10, 12, or 48 inches or any dimension in between to accommodate the size container intended to be stored in the storage rack 108.

Figure 2:
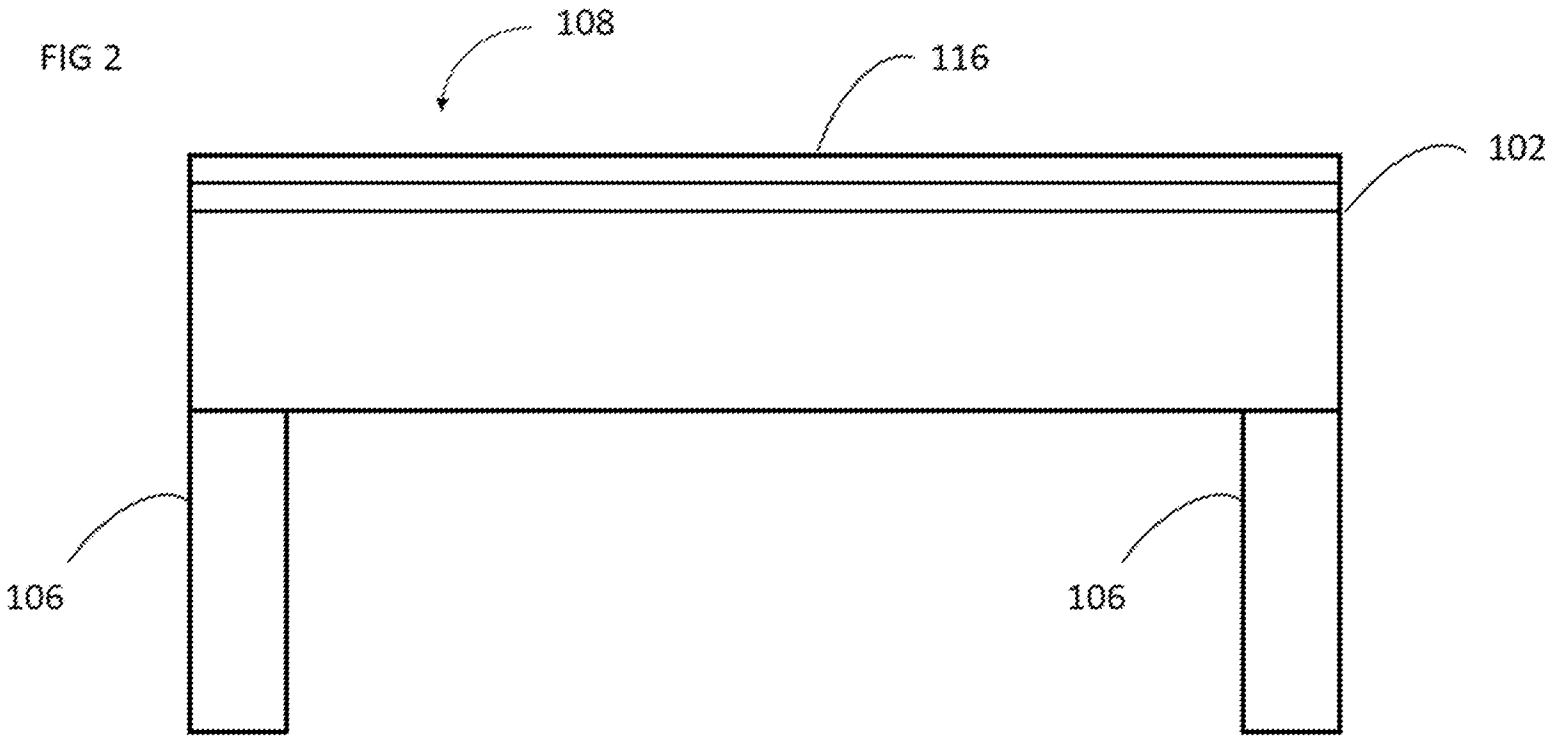
FIG. 2 presents a front view of a storage rack.

As shown in FIG. 2 a front view of a storage rack 108 illustrates a base 102 having a depth. The depth can be commensurate to the size containers intended to be stored and subsequently the depth of the compartments 104 are determined by the size container to be stored. As best seen in FIG. 2 the storage rack 108 includes legs 106. The storage rack can have 4 legs 106 one positioned on each corner under the base 102. The dimensions of the leg 106 can be determined based on the containers to be stored on the storage rack 108. Larger containers with a larger vertical displacement may dictate to have legs 106 sufficiently long in order to allow proper distance between a bottom of a base 102 of a storage rack 108 and a top of a base 102 of a storage rack 108 placed below it. The displacement will be sufficient to allow users to reach into storage racks 108 which are placed on top of one another and to retrieve containers from the lower storage racks 108 without interference with the bottom of the upper storage rack 108. The length of the legs 106 may be 4, 6, 8, 10, 12, 18, 24, or 36 inches or any dimension in between. The appropriate length of the legs 106 will be determined by the containers being stored. The length of the legs 106 is the vertical distance from a bottom of the leg 106 to the bottom of the base 102 to which it is attached.

In embodiments, the storage rack 108 can include a coating 116. The coating can be chosen to provide protection from the environment in which the storage rack 108 will be used. For example, if the storage rack 108 will be in a refrigerated or frozen environment a properly selected coating 116 may protect the storage rack 108. Further, if the storage rack 108 needs to have protection against potential virus or bacterial transmission, an antimicrobial coating may be used.

Figure 3:
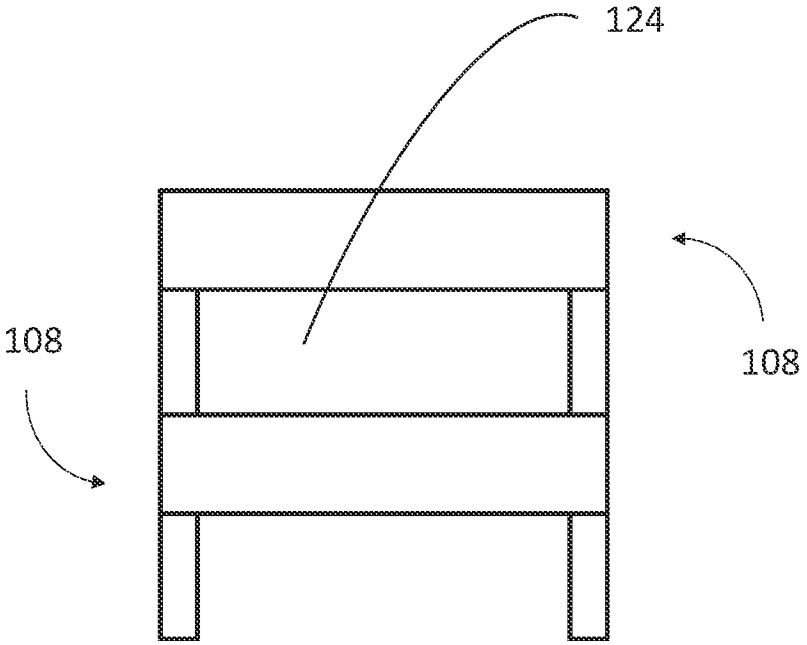
FIG. 3 presents a front view of 2 storage racks stacked vertically.

FIG. 3 displays an embodiment of the system 100 illustrating two storage racks 108 stacked vertically. This embodiment shows the vertical interconnectivity between two storage racks 108. Although other combinations of storage racks 108 are possible the combination of two storage racks 108 may illustrate a novelty of the present invention. As seen in FIG. 3 the space 124 between two vertically stacked storage racks 108 creates a space 124 between an upper storage rack 108 and a lower storage rack 108. The space 124 can be configured to allow easy and convenient access to containers in the lower storage rack 108 without interference from the upper storage rack 108. The length of the legs 106 can define the vertical distance between the bottom of the upper storage rack 108 and the top of the lower storage rack 108. The vertical distance can be varied by varying the length of the legs 106 of the storage racks 108. By increasing the length of the legs 106 the vertical distance afforded in the space 124 and can be designed to allow users to easily retrieve containers from lower storage racks 108 without interference from upper storage racks 108.

Figure 4:
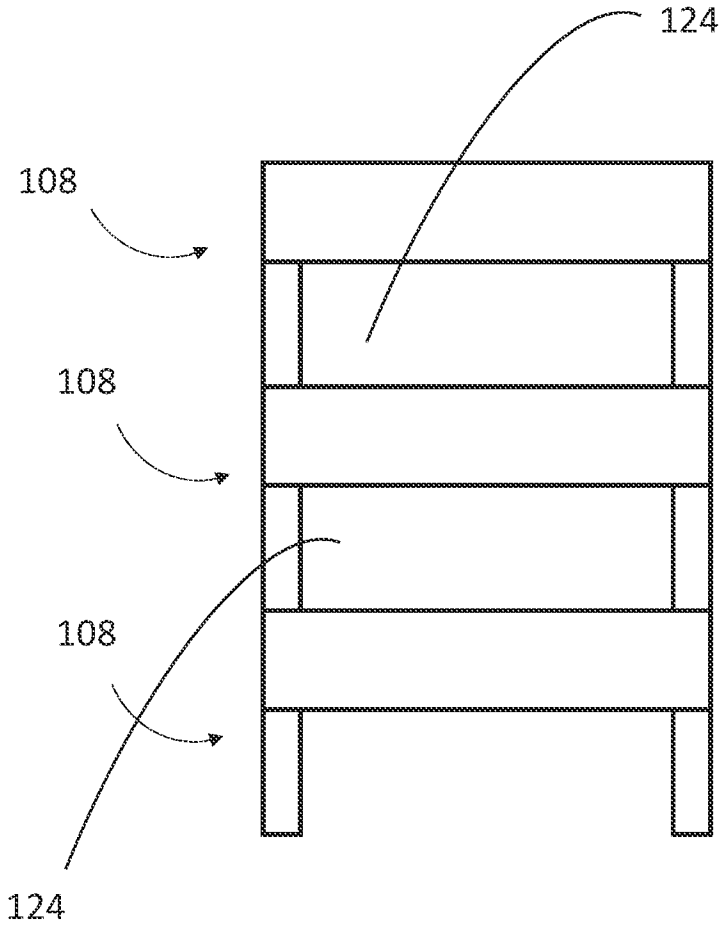
FIG. 4 presents a front view of 3 storage racks stacked vertically.

As best seen in FIG. 4, a plurality of storage racks 108 can be interconnected vertically to create embodiments of the present invention allowing convenient storage of containers such as beverage bottles in a plurality of storage racks 108 placed one on top of another. One of the novelties of the present invention is that the vertical stacking is limited only to physically available space. The drink stacker system 100 can be used in any vertical stacking situation by stacking one storage rack 108 on top of another storage rack 108.

Figure 5:
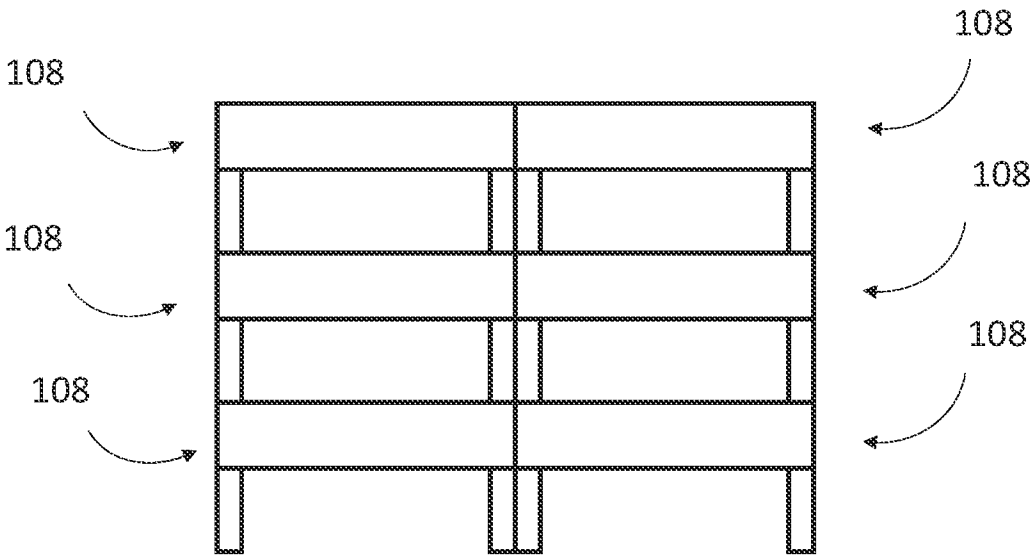
FIG. 5 presents a front view of storage racks interconnected vertically and horizontally.

Referencing FIG. 5, in embodiments of the present invention a plurality of storage racks 108 can be interconnected both vertically and horizontally. Further, the plurality of storage racks 108 interconnected vertically and horizontally are limited only by physical space restrictions. There is no limit to the number of storage racks 108 which can be stacked vertically and interconnected horizontally.

Figure 6:
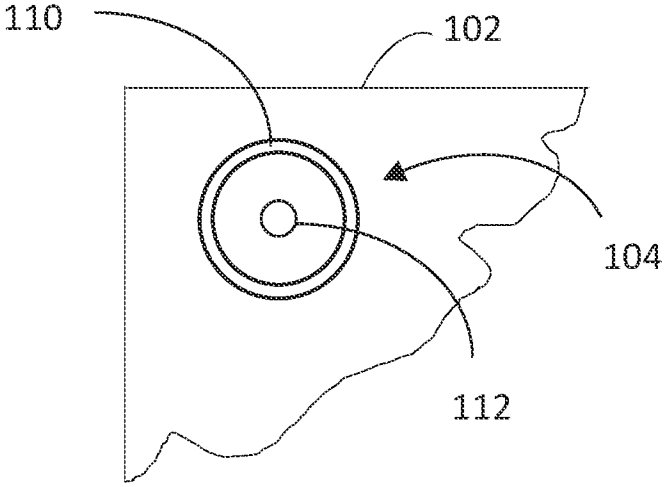
FIG. 6 presents a top view of a compartment having an insulating layer and a drain hole at the bottom of the compartment in accordance with an embodiment of the present invention.

Turning to FIG. 6, shows in an embodiment of the present invention, a cut away view of a compartment 104 in a storage rack 108. The compartment 104 is positionable on the base 102 and can include insulating layers 110 lining the compartment 104. The insulating layers 110 can be arranged to keep hot containers hot and cold containers cold. The thickness of the insulating layers can be configurable based on the intended containers or beverages being stored in the compartments 104. Further, in embodiments, the compartment 104 can include a drain opening 112. The drain opening 112 can be configured to allow condensation from a container to drain through the drain opening 112. Additionally, the compartment 104 can include a drain opening 112 configured to allow cleaning and washing evolutions of the storage rack 108 and permit the draining of the cleaning water through the drain opening 112.

Figure 7:
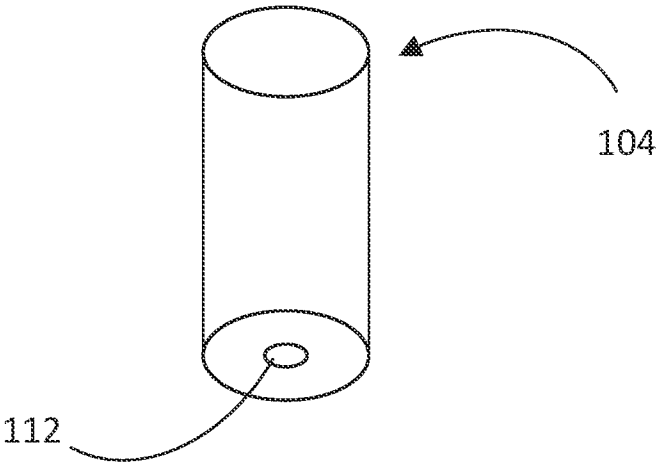
FIG. 7 presents a perspective view of a compartment in an embodiment of the present invention.

FIG. 7 displays a perspective view of a compartment 104 in an embodiment of the present invention. The compartment 104 can include a depth or height of the compartment 104. The depth of the compartment 104 will be determined by the size container intended to be stored on the storage rack 108. Further, the compartment 104 can include an opening. The opening dimensions will be determined by the size container intended to be stored on the storage rack 108.

Figure 8:
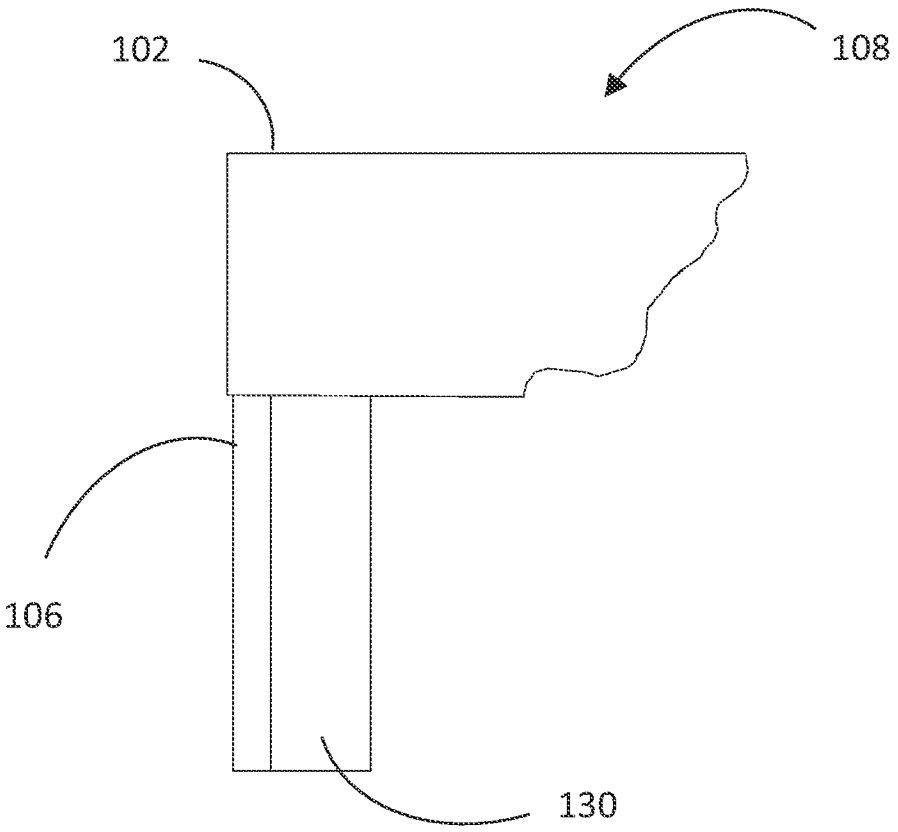
FIG. 8 presents a front view of contoured internal sides of a leg.

FIG. 8 displays a cut out front view of a storage rack 108. As seen in FIG. 8 the legs 106 connect to the bottom of the base 102 and extend a length to the bottom of the legs 106. In embodiments, there are four legs 106 one positioned on the bottom of each corner of the base 102. The length or height of the legs 106 may be determined by the height of the container intended to be placed into the compartment 104. The length of the legs 106 will be sufficient so as to provide easy access by a user to retrieve a container from a compartment 104 of a lower placed storage rack 108 without interference with the upper storage rack 108. Further, in embodiments as shown in FIG. 8 the storage rack can include legs 106 with contoured internal sides 130. The contoured internal sides 130 of the legs 106 are designed to allow users to retrieve containers from lower storage racks 108 and if incidental contact occurs with the legs 106 the contoured internal sides 130 may prevent damage to a user due to elimination of sharp edges or corners.

Figure 9:
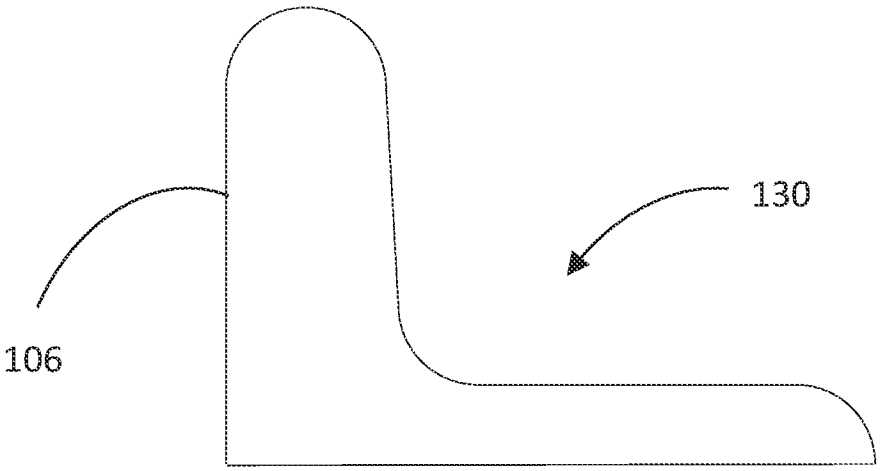
FIG. 9 presents a bottom view contoured internal sides of a leg.

FIG. 9 presents a bottom view of a leg 106 of a storage rack 108 illustrating the contoured internal sides 130. The contoured internal sides 130, as previously discussed, provide a safety feature to the drink stacker system 100.

While the foregoing written description of the exemplary embodiments enables one of ordinary skill to make and use what is considered presently to be the best mode thereof, those of ordinary skill will understand and appreciate the existence of variations, combinations, and equivalents of the specific embodiment, method, and examples herein. The exemplary embodiments should therefore not be limited by the above described embodiment, method and examples, but all embodiments and methods within the scope and spirit of the exemplary embodiments as claimed.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

Insofar as the description above and the accompanying drawings disclose any additional subject matter that is not within the scope of the claims below, the inventions are not dedicated to the public and the right to tile one or more applications to claim such additional inventions is reserved.

What is claimed:

1. A stackable storage rack system suitable for storing containers comprising:

a base;

a plurality of compartments positionable within the base, wherein the compartments form a cavity within the base and have an opening on a top of the base designed to store containers;

at least four legs, wherein a top of the at least four legs are connected to a bottom of the base and wherein each individual leg is configured to connect to the bottom of the base at four separate bottom corners of the base; and an operational space formed by stacking at least two storage racks one on top of one another wherein the operational space is formed between a bottom of the legs and the top of the legs of a top storage rack placed on top of a bottom storage rack wherein users of the system can retrieve containers from the bottom storage rack without interference from the top storage rack and wherein the operational space is determined by a length of the legs of the top storage rack;

wherein the at least four legs include contoured, concave, and smooth inside sections configured to allow users to retrieve containers from lower storage racks providing a safety feature for the users to mitigate abrasive damage to the users' hand by removing sharp edges and sharp corners on an inside of the operational space;

wherein the at least four legs are L-shaped and include curved inside corners in cross section; and wherein the compartments include a sidewall with a depth and a bottom wall attached to the sidewall.

2. The system of claim 1 wherein the bottom of the legs are configured to mate with and rest on a top of the base of another storage rack.

3. The system of claim 1 wherein the base includes at least two elongated supporting rails positioned parallel and inside a bottom of the storage rack configured to secure the containers placed in the compartments.

4. The system of claim 1 wherein the shape of the compartment openings is circular.

5. The system of claim 1 wherein the storage rack includes corrugated depressions on a border of the storage rack designed to provide stability when the storage racks are stacked on top of one another.

6. The system of claim 1 wherein the compartments include a depth wherein the depth is configured to be around 70 percent of a height of the containers designated to be stored in the compartments.

7. The system of claim 1 wherein a height of the storage rack is about 8.35 inches, a depth of the compartments are about 4.84 inches, and a width of the storage rack is about 7.75 inches.

8. The system of claim 1 wherein the compartments include an insulating layer.

9. The system of claim 1 wherein the compartments include a drain hole at a bottom of the compartment.

* * * * *